United States Patent [19]

Fleischhacker et al.

[11] 4,221,445

[45] Sep. 9, 1980

[54] CROSS CONNECT DISTRIBUTION SYSTEM AND APPARATUS

[75] Inventors: James E. Fleischhacker, Winston-Salem, N.C.; Lincoln E. Roberts, Dunedin; Henry G. Wasserlein, Jr., Seminole, both of Fla.

[73] Assignee: AMP Incorporated, Harrisburg, Pa.

[21] Appl. No.: 874,678

[22] Filed: Feb. 2, 1978

[51] Int. Cl.[3] ..... H01R 11/04; H01R 29/00

[52] U.S. Cl. ..... 339/18 R; 339/97 R

[58] Field of Search ..... 339/18 R, 18 B, 18 C, 339/19, 28, 29, 97 R, 97 P, 98, 99 R

[56] References Cited

U.S. PATENT DOCUMENTS

| | | | |
|---|---|---|---|
| 3,234,498 | 2/1966 | Logan | 339/97 |
| 3,308,422 | 2/1967 | Boysen | 339/198 |
| 3,617,983 | 11/1971 | Patton | 339/98 |
| 3,621,449 | 11/1971 | Bridle | 339/99 R |
| 3,760,335 | 9/1973 | Roberts | 339/99 R |
| 3,766,622 | 10/1973 | Brehm et al. | 29/203 MW |
| 3,824,553 | 7/1974 | Glover et al. | 339/198 GA |
| 3,829,821 | 8/1974 | Derr et al. | 339/91 R |
| 3,836,942 | 9/1974 | Knickerbocker | 339/97 R |
| 3,866,996 | 2/1975 | Elkins | 339/99 R |
| 3,887,259 | 6/1975 | Ayer | 339/119 R |
| 3,936,119 | 2/1976 | Ayer | 339/17 F |
| 3,958,853 | 5/1976 | Wilson | 339/99 R |
| 3,963,296 | 6/1976 | Glover et al. | 339/75 M |
| 3,970,802 | 7/1976 | Nijman | 179/98 |
| 3,976,350 | 8/1976 | Keglewitsch | 339/97 P |
| 3,998,514 | 12/1976 | Hardesty | 339/99 R |
| 4,018,997 | 4/1977 | Hoover et al. | 179/98 |
| 4,029,376 | 6/1977 | Headington et al. | 339/19 |
| 4,037,910 | 7/1977 | Paluch | 339/198 R |

OTHER PUBLICATIONS

AMP Product Information Bulletin 7006-2; Nov., 1972.
AMP Data Sheet No. 74-257; published May, 1974.
AMP Data Sheet No. 73-138; published Aug., 1973.
Amphenol Data Sheet 499-134; published Aug., 1974.
AMP Product Information Bulletin 4361-4366; published Oct., 1976.

*Primary Examiner*—Neil Abrams
*Attorney, Agent, or Firm*—Gerald K. Kita; Robert L. Pitts

[57] ABSTRACT

A telecommunications distributing system for use in a building requiring a large number of telephone circuits is disclosed. The assembly employs multi-conductor connectors having two rows of terminals attached to the ends of incoming and outgoing telephone cables. A jumper connector assembly for interconnecting corresponding incoming and outgoing wire pairs is also employed. In one embodiment, the jumper connector establishes an edge contact with the terminals in the multi-conductor connector to minimize the width of the jumper connector.

7 Claims, 12 Drawing Figures

CROSS CONNECT DISTRIBUTION SYSTEM AND APPARATUS

BACKGROUND OF THE INVENTION

1. Field of the Invention

This invention relates to telephone circuit distribution systems and more particularly to a telephone distribution connector assembly employing multi-conductor electrical connector components and jumper assemblies. This invention relates to an assembly for cross-connecting a plurality of incoming telephone wire pairs to telecommunications equipment located in a specific locality such as an office building. This invention also relates to multi-contact electrical connectors and the mating relationship between female receptacle connectors and male plug connectors.

2. Description of the Prior Art

Telephone systems in office buildings require an extensive amount of electrical wiring. Some means must be provided for properly distributing the incoming telephone circuits to the proper location for the specific telecommunications equipment.

A central distribution assembly is generally provided for each office building. A number of cross-connection systems have been proposed for use as a distribution frame. The industry standard comprises a modular connecting block having a plurality of terminals comprising cantilever spring members with an insulation piercing slot therebetween. These modular connecting blocks are generally referred to as 66 blocks. In use, an incoming cable generally consisting of twenty-five pairs of telephone wires, is positioned adjacent to a modular 66 block. The individual wires are then laced into position on the 66 block and wires are attached to the contact terminals utilizing an appropriate hand tool. Wires in an outgoing cable can then be attached to the terminal, and individual wiring patterns can be established. These standard 66 type blocks are labor intensive. An installer must first attach all of the incoming conductors in an incoming cable to the modular connecting blocks. Then the installer must attach the proper wires in the outgoing circuit to the proper terminals. Each of these operations must be performed on-site and the possibility of wiring errors is significant.

One method in which the on-site labor can be reduced, involves the use of multi-conductor electrical connectors generally referred to as miniature ribbon connectors. The most common miniature ribbon connectors, such as that shown in U.S. Pat. No. 3,760,335, are used with a 25 pair electrical cable. A miniature ribbon connector typically has two rows of 25 contact terminals. Wires can be attached to one end of each connector terminal. Miniature ribbon connectors are designed to mate with corresponding connectors. Generally, terminals in a corresponding position in the two rows of a miniature ribbon connector are intended to be attached to the separate wires comprising a single twisted pair.

A factory manufactured assembly consisting of a modular connecting block and a miniature ribbon connector can be fabricated and used to simplify on-site assembly problems. These assemblies are known as connectorized back panels and 66 blocks. By interconnecting appropriate 66 type terminals in the modular connecting block and in a corresponding miniature ribbon connector only one installation step for the incoming cable is necessary. A mating miniature ribbon connector preassembled on the end of an incoming cable is mated with a miniature ribbon connector previously wired to the modular connecting block. Using these miniature ribbon connectors, has simplified a portion of the cross-connectorization assembly process.

An additional method of attaching telephone equipment located on the customer premises to incoming cabling involves the use of pre-manufactured patch cords for interconnecting the incoming and outgoing circuits. Special connector panels are used with these patch cord assemblies. An example is seen in U.S. Pat. No. 3,970,802. One block is used for the incoming cabling and the second is used for the outgoing cabling. With these latter methods, a jumper assembly comprising a single telephone wire pair with plug members at either end of the jumper pair is employed to interconnect associated incoming and outgoing circuits. One jumper plug assembly is attached at the appropriate connector location in the incoming cabling array and the other plug is attached at the proper outgoing connector location.

SUMMARY OF THE INVENTION

The instant invention is a new telecommunication distribution assembly for establishing a plurality of circuits between incoming telecommunications cabling and on-premise telecommunications equipment. These assemblies can comprise a plurality of miniature ribbon connector receptacles attached to both the incoming cabling and the cabling leading to the appropriate telecommunications equipment. Jumper assemblies consisting of a pair of telephone wires with plug members at both ends are used to interconnect incoming and outgoing circuits. These plug members are inserted directly into the miniature ribbon connector receptacles. The plug members comprise an insulating member having plate-like contact terminals therein. In one embodiment of this invention the mating surface on the plug member terminal comprises an edge of the plate-like terminal. This mating edge is intended to establish contact with a flat surface of a resilient mating terminal in a miniature ribbon connector receptacle. The electrical connector plugs have a width which is less than or equal to the spacing between adjacent terminals in the miniature ribbon connector receptacles. Appropriate wire terminating means are provided on the plug terminals for establishing electrical contact with a jumper wire upon movement of the wire laterally of its axis into the wire terminating means. In one embodiment, the wire terminating means comprises a plurality of upstanding tines forming slots between adjacent tines. The edges of the tines are then employed to penetrate the insulation surrounding a conductor and establish electrical contact with the underlying conductive core. Cover members having integral wire stuffers are used to force the wires into the wire terminating means.

The central object of this invention is to provide a telephone distribution assembly which eliminates the need for intermediate modular connecting blocks. Miniature ribbon connectors, generally of the type commonly employed with indoor telecommunications cabling and featuring rapid wire termination capabilities, can be used on the ends of both incoming and outgoing telephone cables. With this invention, corresponding terminal positions in the incoming miniature ribbon connector can be attached to terminals in the outgoing miniature ribbon connector receptacles by the use of a special jumper assembly. No intermediate modular connecting block or jack assembly is necessary. This cross-connectorization distribution assembly results in the use of less labor to install and maintain an on-site telephone system. Miniature ribbon connectors lend themselves to either pre-manufacture or on-site mass termination. The overall time needed for installation is significantly minimized. Space and material savings can also be realized utilizing this approach.

DETAILED DESCRIPTION OF THE INVENTION

Figure 1:
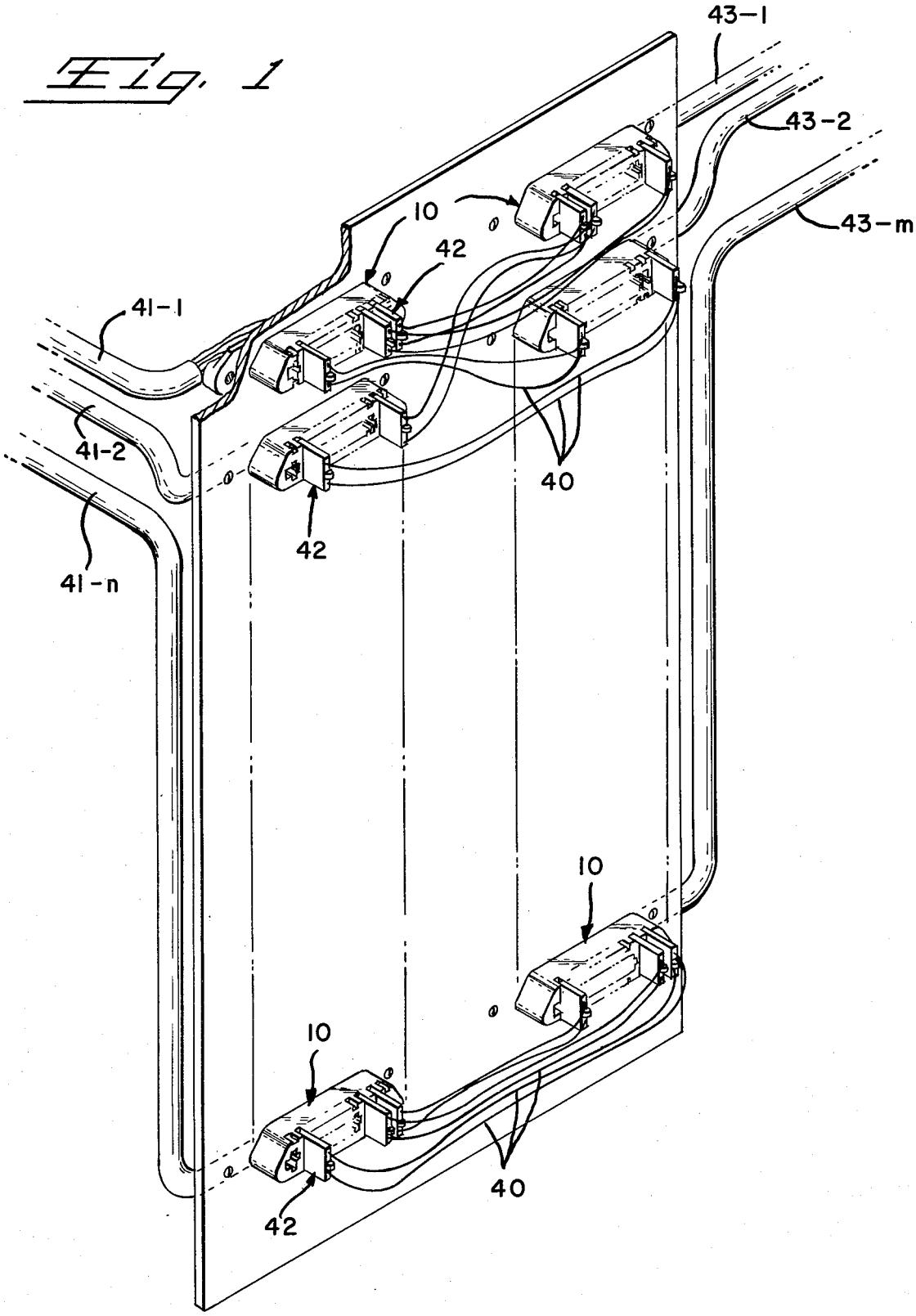
FIG. 1 illustrates a cross-connect panel comprising a plurality of miniature ribbon connector receptacles with jumper plug assemblies interconnecting corresponding incoming and outgoing circuits.

The cross-connect panel assembly shown in FIG. 1 is a representation of a distribution frame assembly which could be substituted for the standard 66 type blocks used in the telephone systems in buildings having a large number of telephone circuits. The assembly shown in FIG. 1 utilizes a plurality of connectors commonly referred to as miniature ribbon connectors. The miniature ribbon connector shown differs slightly from standard miniature ribbon connectors. As used here, the term miniature ribbon connectors refers to both the standard and the modified versions. This invention is consistent with the use of miniature ribbon connectors but is not limited to their use. A connector having a double row of contact terminals, each terminal having a wire receiving element at its first end and a terminal contact element along its second end could be used in such a distribution assembly.

A first portion of the electrical connectors shown in FIG. 1 have been terminated to incoming wires in incoming telephone cables, 41-1, 41-2 . . . **41-*n*. A second remaining portion of these connectors have been similarly attached to a series of outgoing cables, 43-1, 43-2, . . . 43-*m***, also containing a plurality of twisted pair telephone conductors. By utilizing a double sided multi-conductor connector of the type represented by the miniature ribbon connectors shown, significant wire termination advantages are achieved. For example, wires can be rapidly attached to miniature ribbon connectors by utilizing applicator apparatus such as that shown in U.S. Pat. No. 3,766,622, which discloses a semi-automatic applicator machine for use in rapidly terminating wires to a miniature ribbon connector in a factory environment. Also, the applicator tool shown in U.S. Pat. No. 3,758,935 can be used in a field environment to mass-terminate a plurality of wires in a miniature ribbon connector. Mass termination involves generally simultaneous insertion of a plurality of side-by-side wires into a corresponding plurality of side-by-side wire receiving contacts located in a multi-conductor connector.

Figure 2:
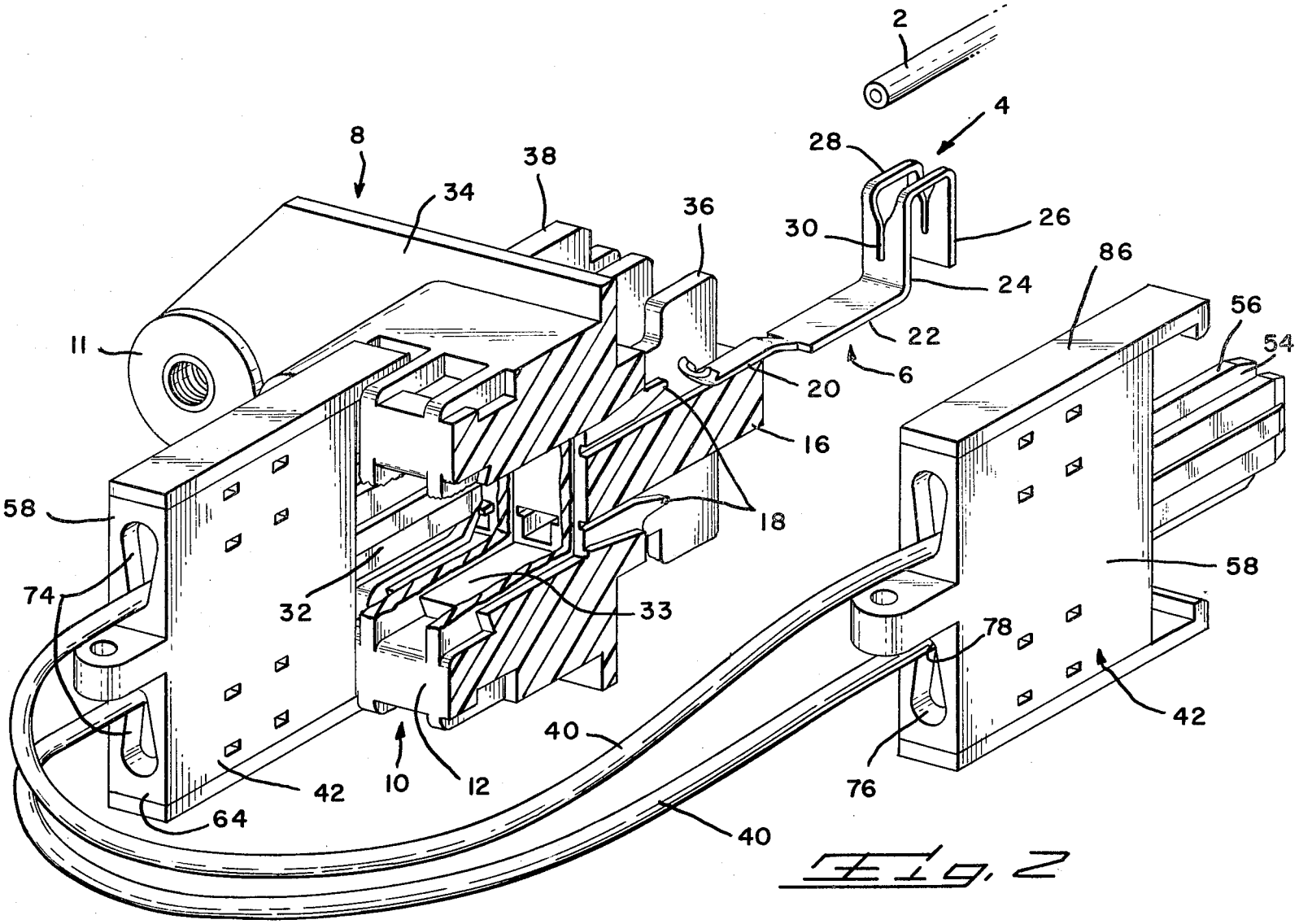
FIG. 2 is a perspective view showing a jumper assembly and a female miniature ribbon connector receptacle.
Figure 11:
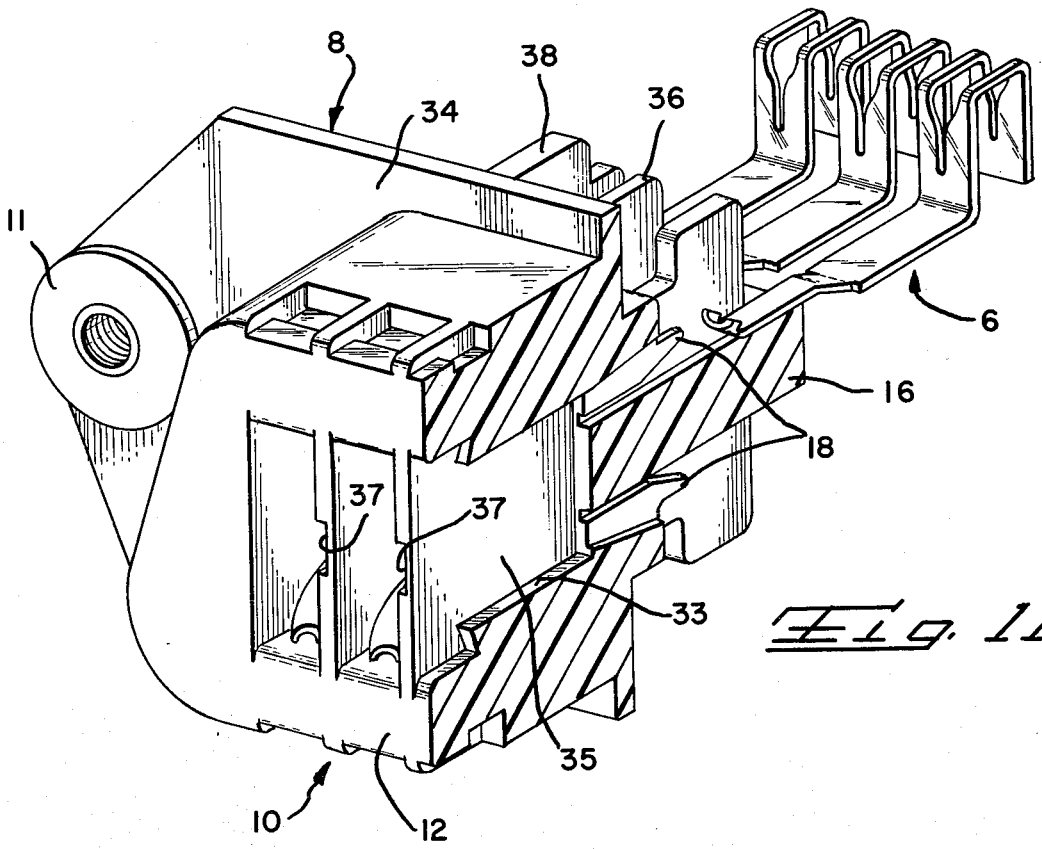
FIG. 11 is a view of a miniature ribbon connector having web members on the mating face and a plurality of commoned terminals.
Figure 10:
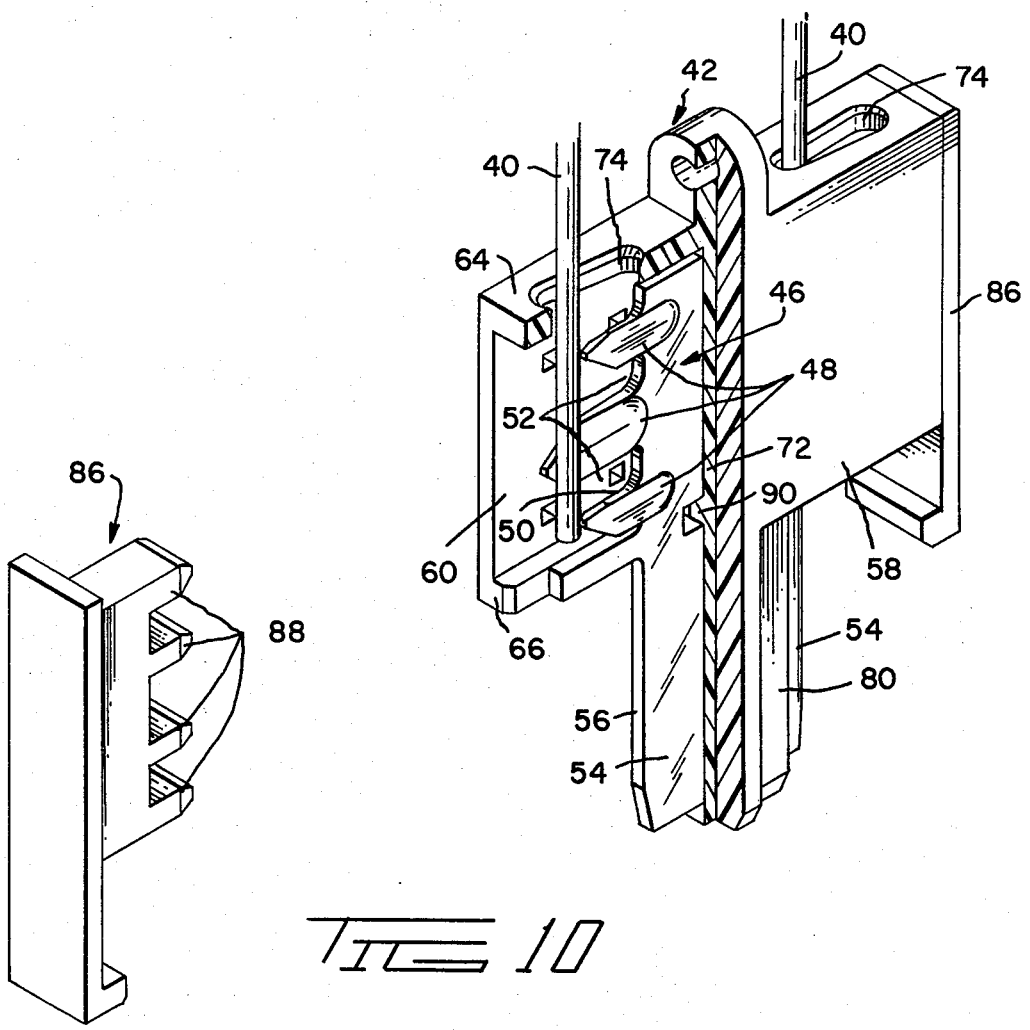
FIG. 10 is a perspective view illustrating the termination of a wire in the jumper plug terminal by use of a cover having integral stuffer means.

FIGS. 1, 2 and 11 more fully illustrate a miniature ribbon connector. Miniature ribbon connectors 8 of the type shown in FIG. 2 are described fully in U.S. Pat. No. 3,760,335. In accordance with the teachings of that patent, FIG. 2 shows wires 2 connected to the wire engaging contact portions 4 of electrical contact terminals 6 which are contained in the housing 10 of the connector 8. The terminals are fabricated from a resilient metal such as beryllium copper. The housing has a mating face or side 12 and a rearward face or side 14. A central rib 16 extends from the rearward side or face and a plurality of side-by-side contact receiving cavities 18 extend through the housing on the upper and lower sides of the rib. Each cavity contains an individual terminal 6 and each terminal has a forward terminal engaging contact portion 20, an intermediate shank 22 and a wire engaging contact portion 4 which comprises two plate-like members 24, 26 which are connected at their upper ends by strap sections 28. The wire 2 is moved laterally of its axis into the gap between the strap members 28 and into slots 30 in the plate sections, the width of these slots being such that the insulation of the wire is penetrated and electrical contact is established with the conducting core. When the terminals are mounted in the cavities, the contact portions extend forwardly and into an elongate female mating recess 32 in the mating face 12 which is adapted to receive a complementary male connector. The sides of the trough-like recess 32 comprise a complementary mating surface 33. The preferred miniature ribbon connector embodiment, shown best in FIG. 11, differs from standard miniature ribbon connectors. A plurality of thin web members 35 extend between oppositely facing complementary mating surfaces 33 of trough-like recess 32. These web members divide the mating side of the miniature ribbon connector into a plurality of separate compartments. Each compartment contains the forward contact portion 20 of two terminals 6, one from each row. Each web 35 has a recessed keyway 37 extending along one surface generally parallel to each terminal 6.

Adjacent terminals in the two rows are separated from each other by barriers 36 and the end barriers 38 extend somewhat beyond the other barriers 36 as shown. The housing 10 is provided with a radially extending flange 34 by means of which it may be mounted in a panel or the like. The ends of wires in the incoming or outgoing cables can be efficiently attached to the wire receiving portions 4 of terminals 6.

Figure 12:
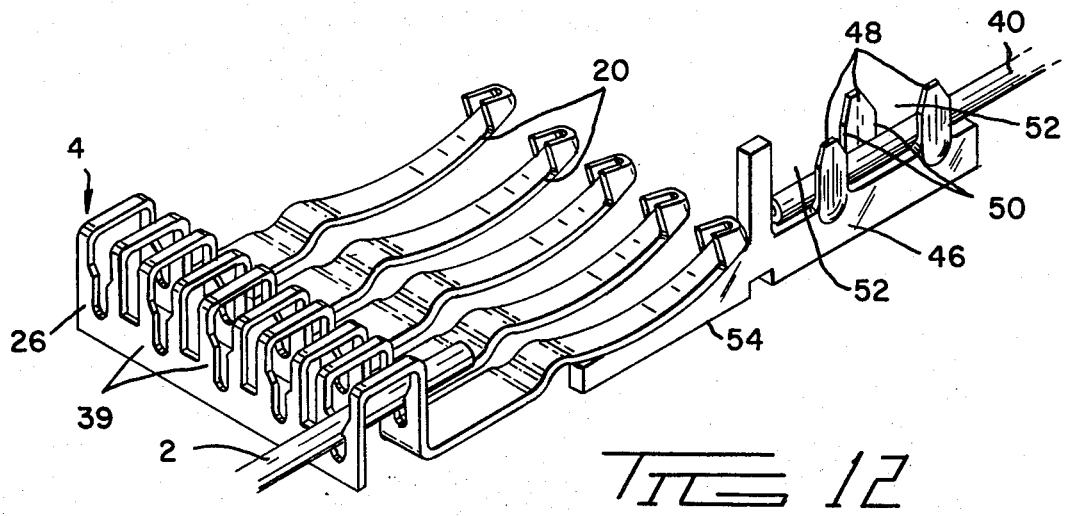
FIG. 12 illustrates the commoned miniature ribbon connector terminals and the mating between jumper and ribbon connector terminals.

Adjacent terminals 6 in the connector can be joined by an integral bridging segment 39, which is best illustrated in FIG. 12. In certain applications a plurality of telephone wires must form a common circuit. This miniature ribbon connector distribution assembly lends itself to the use of either discrete terminals or to a plurality of terminals commoned by integral bridging segments 39.

Figure 3:
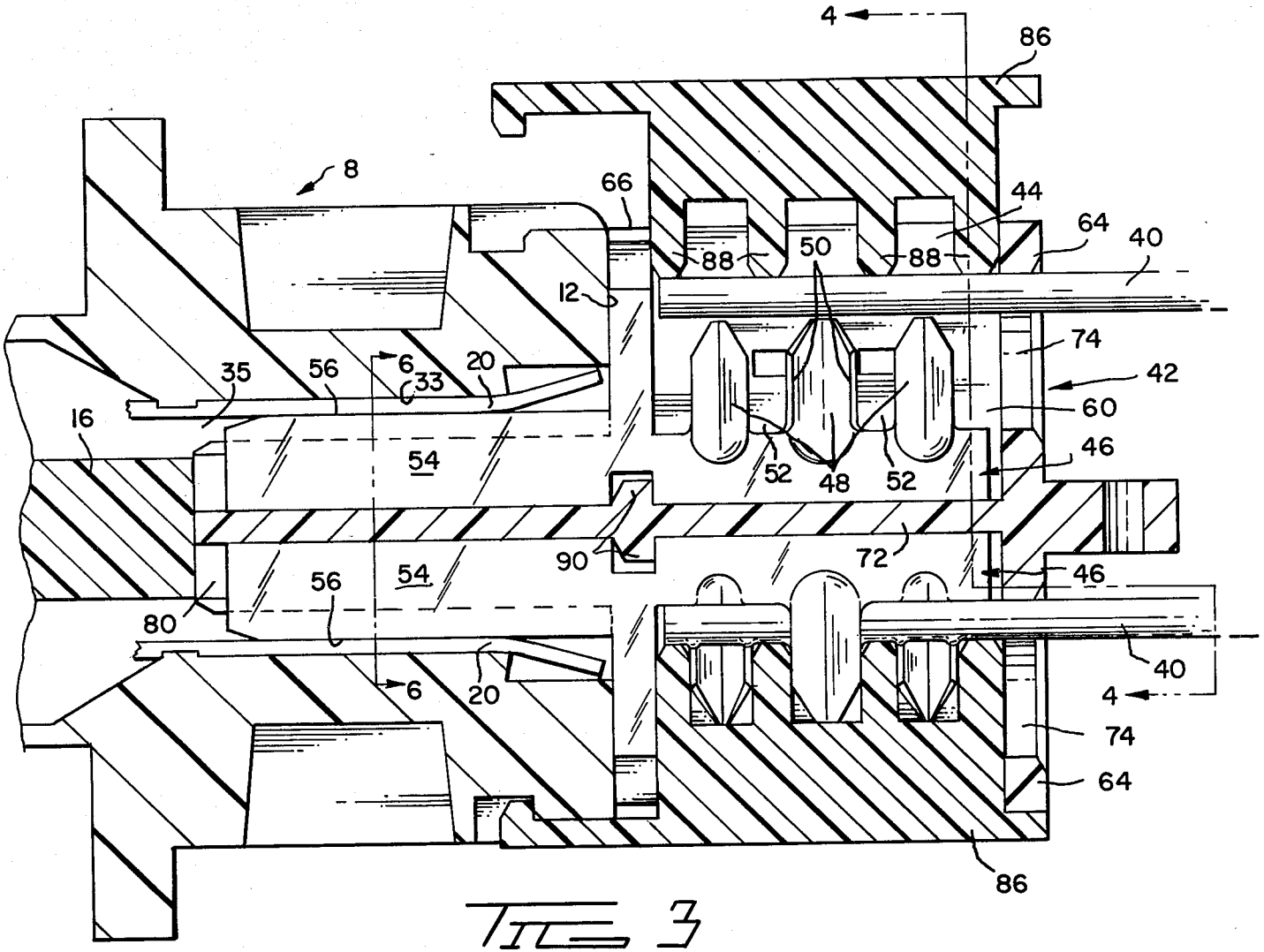
FIG. 3 is a section view showing a mated miniature ribbon connector receptacle and a jumper plug member.

FIG. 3 shows a section view of a jumper connector 42 mated with a miniature ribbon connector receptacle 8. The jumper connector 42 is adapted to be terminated onto the ends of a twisted pair of telephone wires 40. Suitable wires would be 24 AWG solid copper wires. Each jumper connector 42 comprises an insulating member 44 and a pair of contact terminals 46 located on opposite sides of connector 42. Two jumper connectors 42 attached to opposite ends of jumper wires 40 form an assembly which can be used to interconnect corresponding lines in incoming cables 41 and outgoing cables 43.

Figure 9:
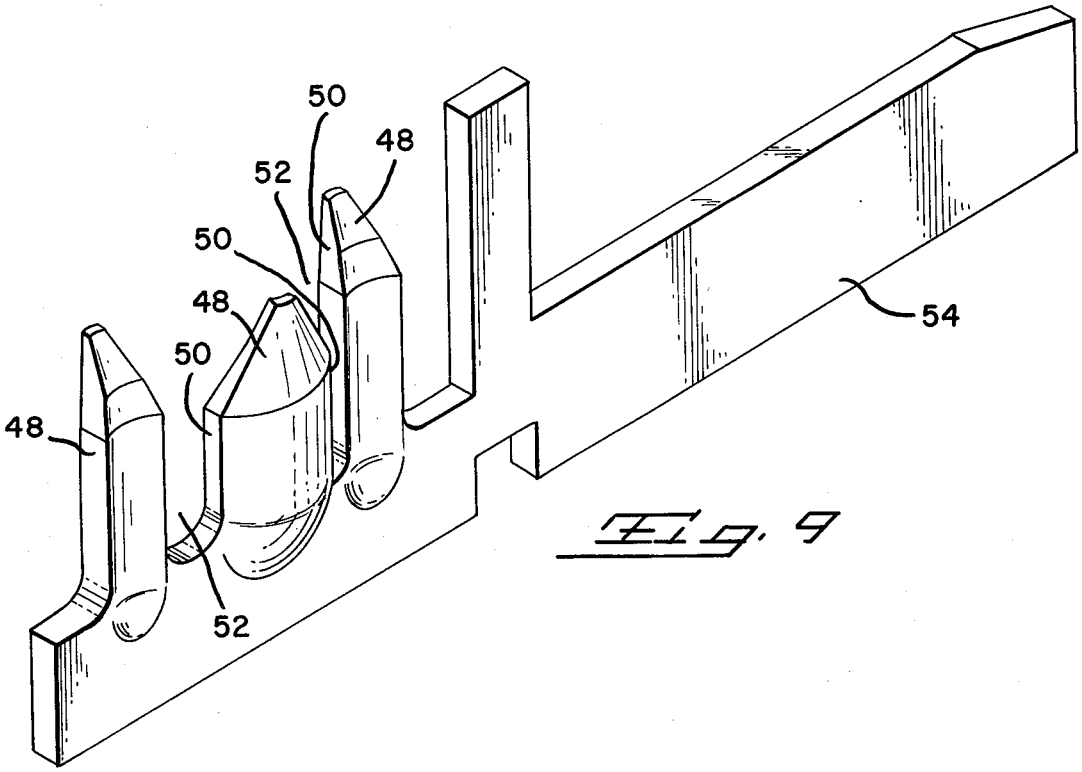
FIG. 9 is a perspective view of the jumper plug terminal.

Each terminal 46 comprises a plate-like member formed of an electrically conducting metal having spring-like properties. Each terminal 46 (also shown in FIG. 9) has a plurality of wire terminating tines 48 located on a first end and a terminal mating contact 54 located on the opposite second end. Tines 48 extend upwardly from one edge of terminal 46. A contact mating edge 56 extends along mating contact portion 54. Tines 48 and contact edge 56 are located along the same edge of terminal 46. Each tine 48 has a pair of contact edges 50. Wire engaging slots 52 are located between adjacent tines 48 and tine edges 50 penetrate the insulation of an electrical conductor forced laterally of its axis into slots 52.

Figures 4, 5, 6, 7, 8:
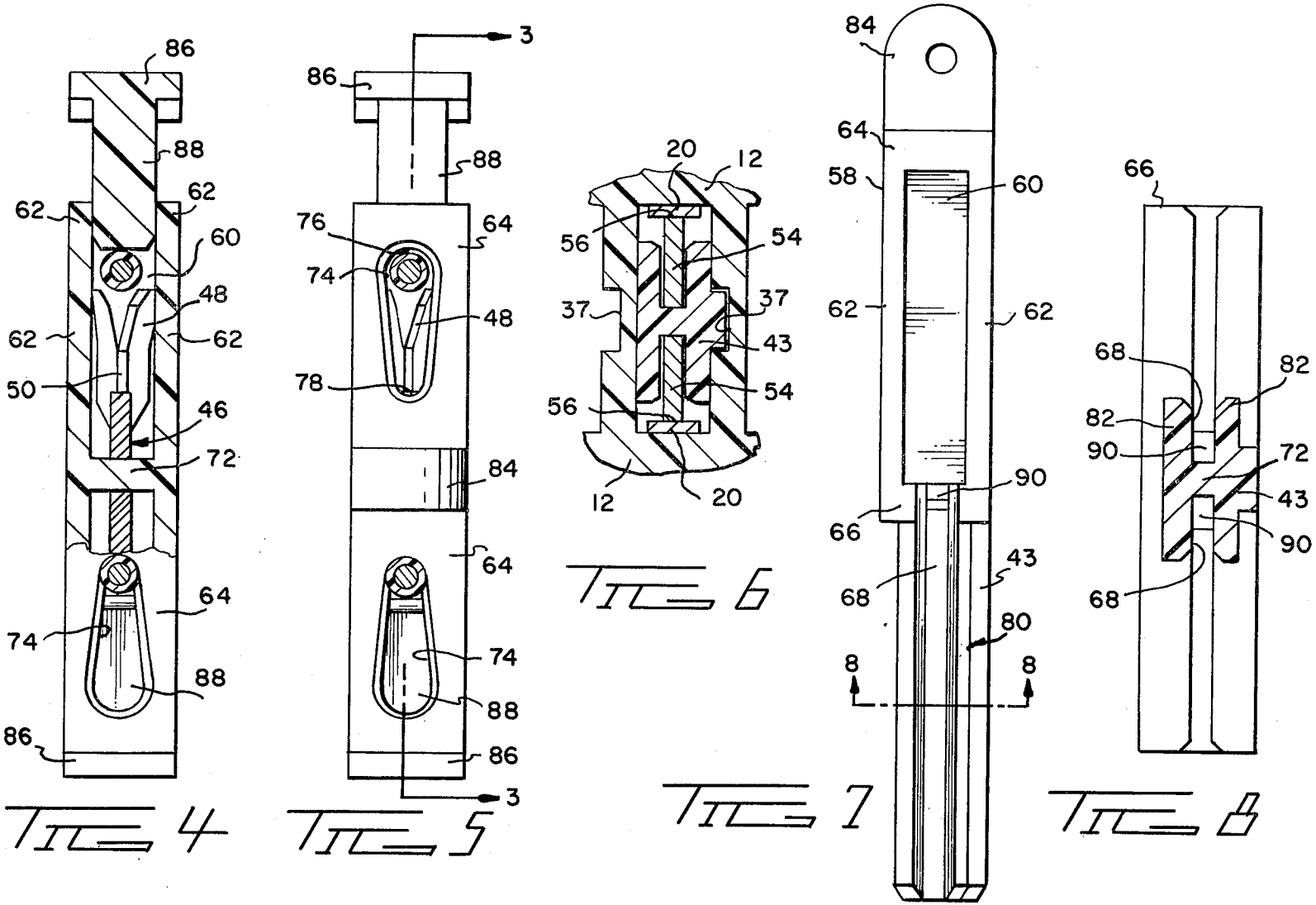
FIG. 4 is a section view taken along section lines 4—4 showing the orientation of the wire terminating contacts in the jumper plug member.
FIG. 5 is an end view of the jumper plug member.
FIG. 6 is a section view illustrating the mating between the terminals in a miniature ribbon connector receptacle and the contact terminals in the plug member.
FIG. 7 is a top view of the jumper plug insulating housing member.
FIG. 8 is an end view of the jumper plug insulating housing.

FIGS. 6 and 12 illustrate the mating between a contact terminal 54 and the appropriate forward contact portion 20 on a terminal 6 in miniature ribbon connector 8. Contact edge 56 is brought into contact with the flat surface of the terminal 6 deflecting the contact portion 20 of the spring-like miniature ribbon connector terminal 6. By orienting the contact terminal 46 in connector 42 in a plane which is generally perpendicular to that occupied by complementary mating surfaces 33 in connector 8 and by contact terminal 6 in connector 8, the lateral dimensions of jumper connector 42 can be minimized. This is especially important when a miniature ribbon connector is utilized. Standard miniature ribbon connectors used in the telecommunications industry have a contact-to-contact spacing equal to 0.085 in. (2.16 cm.). The modified connector of FIG. 11 employing webs 35 imposes a further restriction upon the width of a jumper plug. In order for the distribution assembly depicted here to be functionally compatible, the width of each jumper plug can be no greater than the center-to-center spacing of the contacts in the miniature ribbon connector minus the width of an intervening web 35. An elongated key 43 extends along one side of jumper connector 42. Key 43 has a generally rectangular cross-section and is dimensioned for receipt in keyway 37.

Insulating member 44 comprises a wire-receiving housing 58 and mating segment 80. Wire-receiving housing 58 has a pair of oppositely facing open-ended cavities 60. Open-ended cavities 60 are defined by opposite housing sidewalls 62 and by outer end wall 64 and an intermediate end wall 66. Open-ended cavities 60 have a generally rectangular cross-section and are dimensioned to receive the wire terminating tines of a single terminal 46.

An inner longitudinal barrier 72 extends between the two extreme ends of insulating member 44. Barrier 72 is centrally located and divides the connector member into two halves. A pair of longitudinal terminal receiving passages extend from wire-receiving housing 58 into mating segment 80. A vertical groove 90 is formed in the intermediate end wall 66 of wire-receiving housing 58. Longitudinal terminal receiving passages 68 thus comprise a generally collinear groove beginning in each open-ended cavity 60 extending through the vertical housing groove 90 and into the mating segment 80 to form a trough-like terminal receiving passage. Vertical groove 90 is tapered and serves to retain a terminal 54 wedged into the bottom portion. Note that the cross-section of the mating segment 80 as seen in FIG. 6 has a generally H-shaped configuration formed by mating-side-walls 82 and inner barrier 72. Each terminal is received in the oppositely facing troughs formed in the H-shaped mating segment. The open end of the H-shaped mating segment comprises a mating face.

A pair of generally elliptical elongate wire-receiving openings extend through the outer end wall of wire-receiving housing 60. Openings 74 in end wall 64 have a generally wider outer root section 76 and a generally narrower inner root section 78. By inserting a wire 40 through elongate opening 74 and into position in open-ended cavity 60, jumper wires 40 can be easily terminated. The inner root section also provides strain relief for the terminated wires.

Cover member 86, which has a plurality of depending stuffers 88, can be received within each open-ended cavity 60. When cover 86 is in the open position, a wire 40 can be inserted between stuffers 88 and wire terminating tines 48. By pressing cover 86 into its closed position within cavities 60, stuffers 88 force each conductor into wire engaging slot 52 forming a sound electrical contact between each jumper wire and each terminal 42. Assembly of the jumper connectors can be carried out in a factory or a field environment. In the field, an operator can cut two jumper wires to the proper length. The opposite ends of the jumper wires can then be inserted through the upper wider root section of tapered openings 74. Insertion force for these contacts is rather low. Using an ordinary pair of pliers, the opposite cover members 86 can be pressed together to mechanically secure and electrically terminate the wires 40 to jumper connectors 42.

The jumper connector can now be easily inserted into a receptacle portion of a miniature ribbon connector 8. Oppositely facing contact edges 56 on opposite terminals 46 then engage corresponding terminals 6 in the miniature ribbon connectors. In the embodiment shown herein, the jumper connector comprises a plug or male connector member which can be mated with the receptacle or female miniature ribbon connector. This invention is, however, entirely consistent with the use of a female jumper connector and a male miniature ribbon connector.

By utilizing a jumper plug assembly which mates directly with the mating face of a miniature ribbon type connector significant simplification of the central distribution assembly is possible. The entire assembly now consists of a plurality of miniature ribbon type connectors attached directly to incoming and outgoing cables plus intermediate jumper plug or shunt assemblies. No intermediate modular connecting blocks are necessary. The fabrication of the central distribution assembly is also simplified. Cables can be attached to miniature ribbon type connectors using standard applicator tools. The jumper connector assembly can also be easily assembled. The following claims are directed to the inventive concept incorporated in the central telecommunications distribution system disclosed in the form of the preferred embodiment. This inventive concept is, of course, not limited to the embodiment shown.

We claim:

1. A telecommunications distribution assembly for establishing a plurality of circuits between incoming telecommunications cabling and on-premise telecommunications equipment, said assembly comprising:

(a) a plurality of multi-position miniature ribbon connector receptacles of the type having two rows of receptacle contact terminals, corresponding terminals in opposite rows in certain incoming connector receptacles connected each to one of the wires in an associated pair of incoming conductors in said cabling, terminals in the remaining, outgoing connector receptacles being connected to wires leading to the on-premise telecommunications equipment, said receptacle contact terminals having resilient receptacle contact portions located in two rows along opposite sides of a mating recess on one side of said receptacles, (b) a plurality of jumper assemblies, each comprising a pair of conductors both attached to a plug member at each end, each said plug member further comprising:

(i) a first insulating member having a wire-receiving portion with a receptacle mating portion having a generally H-shaped cross-section, (ii) a pair of longitudinal passages in said first insulating member, each extending from one said wire-receiving portion to one said receptacle mating portion, (iii) a plug terminal member of planar plate form in each passage, said plug terminal member having a wire-receiving contact having conductor engaging tines offset from the plane of said plate and positioned in said wire-receiving portion and a mating contact segment located along said mating portion of said first insulating member, and provided with one edge across the thickness of said plate extending partially beyond said H-shaped mating portion for establishing electrical contact with the resilient receptacle contact portions of the terminals in said miniature ribbon connectors, (c) said interconnection assembly being formed by positioning plug members within said mating recess of one of said receptacles in alignment with opposite corresponding receptacle terminals in incoming and outgoing receptacles to interconnect incoming wires to wires leading to telecommunications equipment.

2. A telecommunications distribution assembly for establishing a plurality of circuits between incoming telecommunications cabling and on-premise telecommunications equipment, said assembly comprising:

(a) a plurality of multi-positioned miniature ribbon connector receptacles of the type having two rows of receptacle contact terminals, with corresponding terminals in opposite rows in certain incoming connector receptacles connected each to one of the wires in an associated pair of incoming first wires in said cabling, and with terminals in outgoing connector receptacles being connected to second wires leading to the on-premise telecommunications equipment, said terminals having resilient receptacle contact portions located in two rows along opposite sides of a mating recess provided into one side of a corresponding one of said receptacles, (b) one or more jumper assemblies, each comprising a pair of conductors having their ends electrically and mechanically secured to plug members, each jumper assembly having one said plug member thereof inserted into said mating recess of a selected said incoming receptacle and a remaining said plug member thereof inserted into said mating recess of a selected said outgoing receptacle, so that said pair of conductors interconnect corresponding terminals of said selected incoming receptacle with corresponding terminals in said selected outgoing receptacle, each said plug member including:

(i) a housing having a wire receiving portions, for receiving ends of corresponding conductors and a receptacle mating portion for pluggable insertion into a mating recess of a selected receptacle, and (ii) a pair of conductive jumper terminals in said housing, each having wire engaging tines electrically secured to an end of a corresponding said conductor and a relatively planar plate portion, each said pair of jumper terminals having edges across the thicknesses of their planar plate portions facing in opposite directions and perpendicular to corresponding receptacle terminals, with said edges of said jumper terminals engaging opposed corresponding receptacle terminals.

3. The structure as recited in claim 2, wherein, each housing wire receiving portion includes a pair of openings in an end wall receiving therethrough insulation covered wires which are in alignment with insulation penetrating edges of said terminals, and further including, an insulative member entering into each said housing wire receiving portion to engage and move a corresponding wire laterally of its length along one said wall opening and into electrical connection with said penetrating edges of one said terminal.

4. The structure as recited in claim 2, wherein, each said housing wire receiving portion includes an opening having, a first section freely receiving a corresponding wire therethrough, and a second section of width narrower than the outer diameter of a corresponding wire and providing a strain relief for a corresponding wire moved laterally of its axis from said first section into said second section.

5. The structure as recited in claim 2, wherein, each said insulative member includes means for latching a corresponding jumper assembly to a corresponding connector receptacle.

6. The structure as recited in claim 5, wherein, each said housing wire receiving portion includes an opening having a first section freely receiving a corresponding wire therethrough, and a second section of width narrower than the outer diameter of a corresponding wire and providing a strain relief for a corresponding wire moved laterally of its axis from said first section into said second section.

7. An electrical connector plug for use in a jumper assembly for interconnecting incoming and outgoing conductor pairs, said conductor pairs being attached respectively to terminals in incoming and outgoing miniature ribbon connector receptacles, in which receptacle terminals attached to associated conductors in each conductor pair are oppositely positioned on the sides of a receptacle mating recess, said electrical connector comprising:

(a) an insulating member having a width generally less than or equal to the spacing between adjacent terminals in said miniature ribbon connector receptacles, and further comprising:

(i) a wire receiving housing on one end thereof, said housing having a pair of lateral oppositely facing open-ended cavities and an elongate wire-receiving-slot communicating with each open-ended cavity for receiving a wire inserted into said one end of said insulating member, (ii) a mating segment, extending from said wire receiving housing, dimensioned to be received in the receptacle mating recess of a miniature ribbon connector, said mating segment having a generally H-shaped cross-section, forming oppositely facing channels, (b) two plate-like plug terminals in said insulating member, each terminal further comprising:

(i) wire terminating means in said open-ended cavities of said wire-receiving housing for establishing electrical connection with a jumper wire upon movement of said jumper wire laterally of its axis along both said wire-receiving slot and said open-ended cavity, and (ii) mating contact means in each channel on said mating segment, one edge of said mating contact means extending beyond said channel for establishing contact with an appropriate mating surface on a terminal in said receptacle, said wire terminating means includes a conductive plate terminal having tines offset from the plane of said plate and electrically engaging said corresponding jumper wire, and said mating contact means comprises a portion of said plate, with said edge of said mating contact means comprising an edge across the thickness of said plate.

* * * * *